United States Patent [19]

Salzgeber et al.

[11] 4,052,971

[45] Oct. 11, 1977

[54] FUEL INJECTION PUMP AND TIMING CONTROL THEREFOR

[75] Inventors: Daniel E. Salzgeber, Windsor; Robert Raufeisen; Charles W. Davis, both of Simsbury, all of Conn.

[73] Assignee: Stanadyne, Inc., Hartford, Conn.

[21] Appl. No.: 621,608

[22] Filed: Oct. 10, 1975

[51] Int. Cl.[2] ..... F02M 59/20

[52] U.S. Cl. ..... 123/139 AQ; 123/140 MC; 123/140 MP; 417/462

[58] Field of Search ..... 123/139 AL, 139 AM, 123/139 AQ, 140 MP, 140 FG; 417/462, 219, 221, 245, 294, 485, 253, 254

[56] References Cited

U.S. PATENT DOCUMENTS

| | | | |
|---|---|---|---|
| 3,416,505 | 12/1968 | Barber | 123/139 AQ |
| 3,536,421 | 10/1970 | Kemp | 417/294 X |
| 3,676,023 | 7/1972 | Andrusenko et al. | 417/462 X |
| 3,680,536 | 8/1972 | Clark | 123/139 AM X |
| 3,726,263 | 4/1973 | Kemp | 123/140 MP X |
| 3,758,240 | 9/1973 | Kemp et al. | 417/462 |
| 3,861,835 | 1/1975 | Bakti | 417/462 |
| 3,869,226 | 3/1975 | Sosnowski | 417/462 |
| 3,897,764 | 8/1975 | Bakti | 123/139 AQ |
| 3,943,902 | 3/1976 | Skinner | 123/139 AQ |
| 3,968,779 | 7/1976 | Davis | 123/139 AQ X |

*Primary Examiner*—Carroll B. Dority, Jr.
*Assistant Examiner*—Tony M. Argenbright
*Attorney, Agent, or Firm*—Prutzman, Hayes, Kalb & Chilton

[57] ABSTRACT

A liquid fuel injection pump for supplying timed charges of fuel to an engine by timed pumping strokes includes an adjustable timing mechanism for changing the timing of the pumping strokes. The timing mechanism includes an advance piston which is variably positionable in response to two different hydraulic control pressures. A speed related control pressure operates a servo mechanism associated with the advance piston to provide a component of speed advance. The reference position of a servo spring associated with the servo mechanism is varied by the second control pressure acting against a piston which mounts the spring and which is biased to a position of relatively advanced timing, thereby to add a component of advance which modifies or supplements the speed advance. The second control pressure is correlated with engine load and/or acceleration and in one embodiment is derived from the positioning of the fuel metering means and in another embodiment is derived from the intake manifold air pressure such as that from a turbocharged engine so that the timing is relatively advanced at low loads and during acceleration, and is relatively retarded at higher loads. A gate controlled by the position of a fuel limiting plunger coacts with the advance piston's servo mechanism to prevent advance of the advance piston during engine cranking, and maximum fuel delivery per pumping stroke is controlled according to intake manifold air pressure.

17 Claims, 7 Drawing Figures

FIG. 4
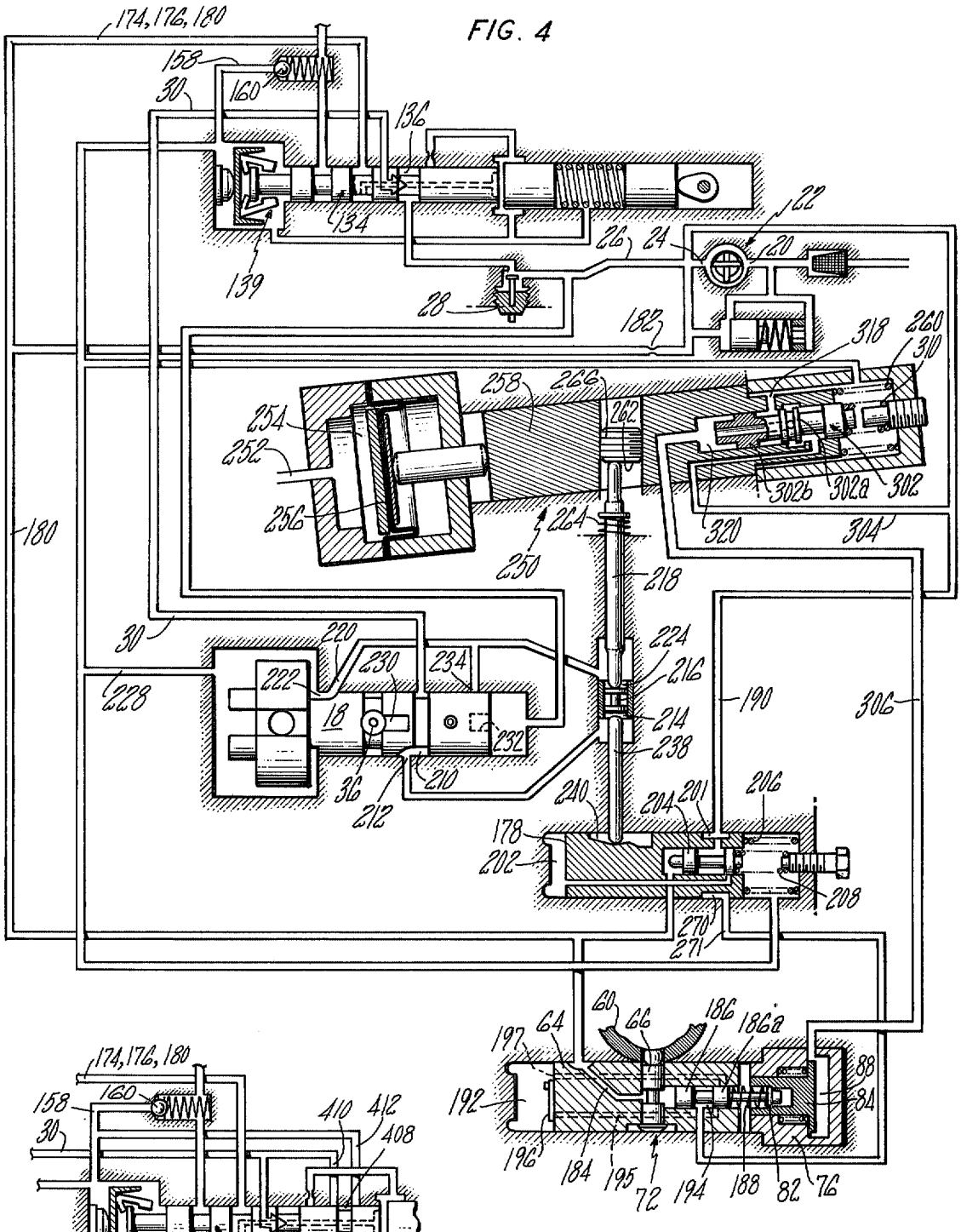
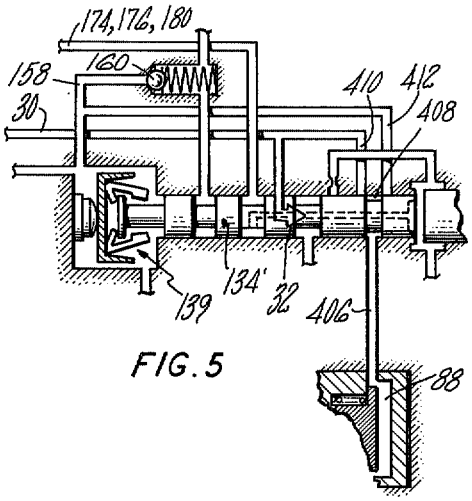
FIG. 5
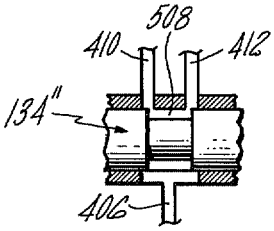
FIG. 6

FUEL INJECTION PUMP AND TIMING CONTROL THEREFOR

BRIEF SUMMARY OF THE INVENTION

The present invention relates to an improved fuel injection pump for compression-ignition engines and the like.

Fuel injection pumps of the type involved in this invention deliver metered charges of liquid fuel under high pressure to the cylinders to an associated engine in timed relationship to their operation and are exemplified by the pump disclosed in U.S. Pat. No. 3,861,833 of Daniel Salzgeber et al for "Fuel Injection Pump" dated Jan. 21, 1975. Such fuel injection pumps are effective over a wide speed range and effectively govern the engine to provide substantially constant speed operation under widely varying loads.

These pumps conventionally have a speed advance with constant end of injection, and best performance is normally obtained when injection begins at an enging crank angle well before top dead center (TDC) for full load and with somewhat less advance for no load. In an effort to reduce exhaust emissions, it has been necessary to relatively retard the full load advance timing, however, the no load injection timing then is so delayed that unwanted exhaust emissions result. Additionally, in highly turbocharged engines, excessive acceleration smoke occurs during transient periods of rapid acceleration before the turbocharger achieves steady state operation at the new throttle setting.

Accordingly, it is a principal object of the invention to provide a new and improved fuel injection pump which includes a pump timing advance arrangement which modifies the timing in accordance with engine operating conditions. Further included in this object is the provision of an injection pump advance mechanism which is responsive to engine load conditions.

It is another object of the invention to provide a fuel injection pump having an advance mechanism which advances the injection timing under light load conditions at a constant speed.

It is still another object of the invention to provide a fuel injection pump having a mechanism for retarding the injection timing during cranking or starting.

It is an even further object of the invention to provide a fuel injection pump having a light load advance mechanism for a turbocharged engine in which the load related advance control signal is derived from engine intake manifold air pressure.

It is a still further object of the invention to provide a fuel limiting mechanism for varying the maximum fuel charge to the engine in correlation with pressure of the intake air supplied to the engine.

It is still another object of the invention to provide a fuel injection pump for a turbocharged engine which advances the timing during the transient periods of acceleration.

It is yet another object of the invention to provide a light load advance mechanism having the load related advance signal correlated with the amount of fuel being delivered to the engine. Included in this object is the provision of an on-off load related advance signal for light load turn-up of injection timing.

Another object is the provision of a continuous modulated load related advance signal proportional to the positioning of the fuel metering mechanism for light load advance across a prescribed load range.

Other objects will be in part obvious and in part pointed out more in detail hereinafter.

A better understanding of the invention will be obtained from the following detailed description and the accompanying drawings of an illustrative application of the invention.

BRIEF DESCRIPTION OF THE DRAWINGS

In the drawings:

FIG. 4 is a schematic view of the pump of FIG. 1 showing the hydraulic circuits thereof;

FIG. 5 is a partial schematic view similar to FIG. 4 showing a fuel metering valve modification for developing an on-off hydraulic control pressure to control the pump timing;

FIG. 6 is a partial schematic view similar to FIG. 5 showing a further modification of the fuel metering valve to develop a modulated hydraulic control pressure.

DESCRIPTION OF A PREFERRED EMBODIMENT

Figure 1:
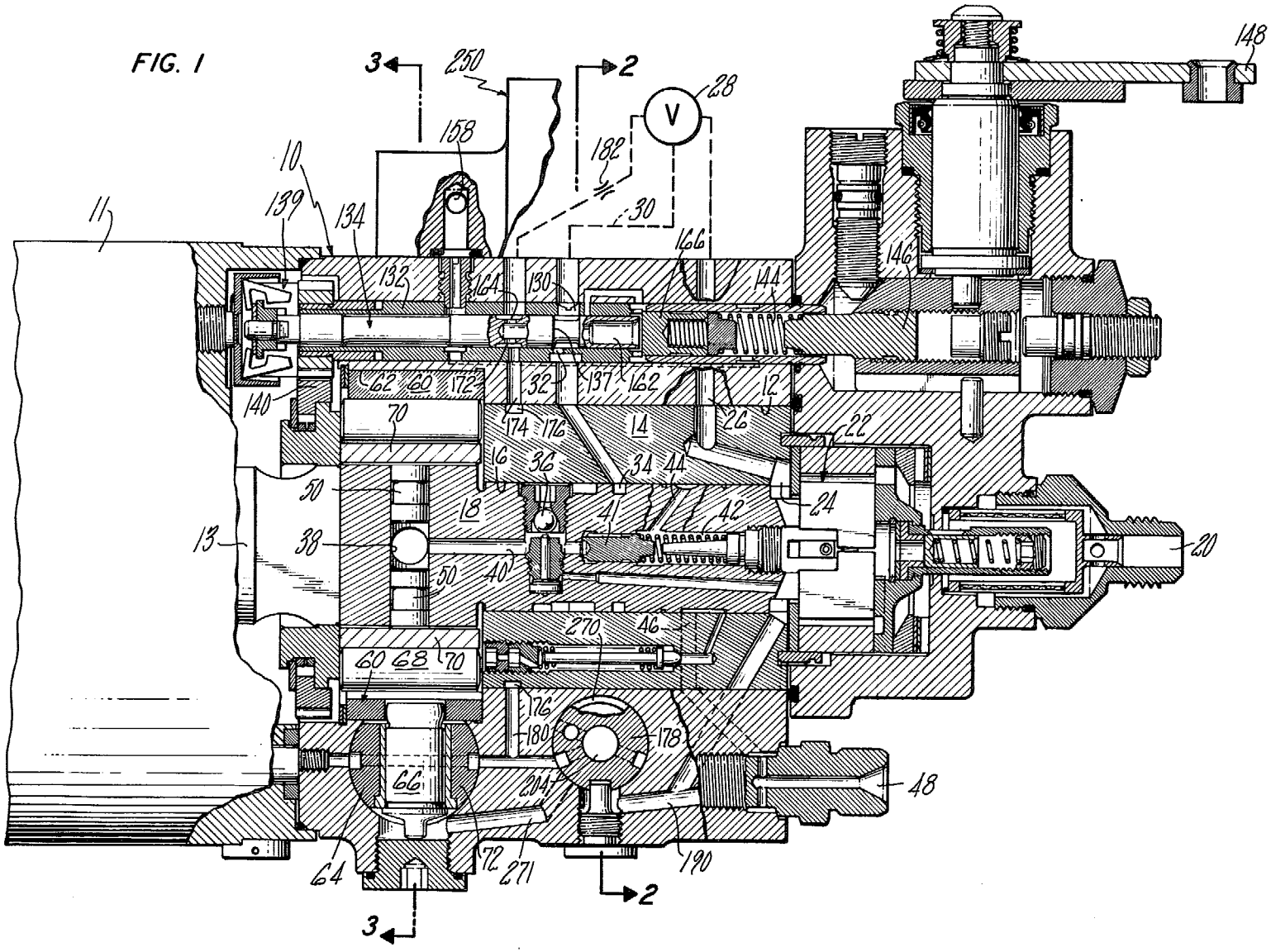
FIG. 1 is a cross-sectional view of an exemplary fuel injection pump embodying the present invention.

Referring now to the drawings in detail, an exemplary pump incorporating the present invention is illustrated. The pump is similar in many respects to the pump disclosed in the aforementioned U.S. Pat. No. 3,861,833 and to which reference may be made for additional detail. The pump has a hydraulic head 10 with a cylindrical bore 12 in which a sleeve 14 is secured. The sleeve 14 in turn provides a cylindrical bore 16 in which a distributor rotor 18 is rotatably mounted. Hydraulic head 10 is supported by a drive housing 11 which includes a mounting flange for attaching the pump to an associated engine and surrounds a drive shaft 13 connected to the engine to drive the rotor 18.

Briefly stated, filtered fuel from a supply tank (not shown) is delivered to the pump inlet 20 to a vane type, low pressure inlet or supply pump 22, the output of which is pressurized to a pressure correlated with engine speed and hereinafter referred to as the transfer pressure. The output is delivered to a large annular groove 24, through passage 26, and past an electric shut-off valve 28 which serves to shut off fuel delivery by the pump independent of governor operation. From the shut-off valve, the fuel flows through a passage 30 and a triangular shaped metering port 32 to an annulus 34 formed on the periphery of the distributor rotor 18 with the metered fuel pressure in the annulus 34 having a pressure regulated by the metering valve 134. From the annulus 34, and by way of additional passages including a low pressure shuttle chamber 224 (FIG. 4), the fuel flows past a one-way rotor mounted ball check valve 36 and through axial passage 40 to pump chamber 38.

The pump chamber 38 is shown as being formed by a pair of intersecting transverse bores in an enlarged part of the rotor. A pair of opposed plungers 50 (FIG. 3) are mounted for reciprocating movement in each bore. Surrounding the distributor rotor in the plane of revolution of the plungers 50 is a generally annular cam ring 60 which is journaled in a cylindrical recess 62 for a limited arcuate movement. The cam ring 60 is restrained from rotating by an adjustable timing advance piston 64 and a connecting pin 66 which interconnects the advance piston 64 and the cam ring 60.

Cam rollers 68 and cam roller shoes 70 are carried by the rotor between the plungers 50 and the cam ring. When metered fuel is admitted to the pump chamber 38, the plungers 50 move radially outwardly to receive the charge of fuel delivered to the pump chamber. At this time, the cam rollers 68 are positioned between the adjacent cam lobes of the cam ring 60. Rotation of the rotor 18 then causes the rollers 68 to pass over the cam lobes of cam rings 60 to translate the profile of the cam into reciprocal motion of the plungers to pressurize the charge of fuel in the pump chamber 38 on the inward stroke of the plungers 50.

The fuel is pressurized to a high pressure, say, up to 12,000 psi, in chamber 38, and is delivered through passage 40, past delivery valve 41, and into delivery chamber 42. From the delivery chamber 42, the pressurized fuel flows through diagonal distributing passage 44 which registers sequentially with a plurality of passages 46 to the outlet 48 for sequential delivery to the injector for each of the several cylinders of the associated engine.

The following is a more detailed description of the exemplary pump with particular emphasis being given to the novel arrangement for angularly shifting the cam ring 60 to change the timing of fuel injection in a manner which optimizes the combination of desired engine performance and reduced exhaust emissions.

A metering valve 134 is rotatably and slideably mounted in governor tube 132 which has a necked-down portion 136 aligned with inlet port 130 to provide an annulus 137 within the governor tube. The metering port 32 provided in the governor tube 132 is axially aligned with the shoulder of the metering valve at the left end of annulus 137 so that the degree of opening of metering port 32 is determined by the axial position of the metering valve 134.

The governor flyweight assembly 139 is connected to exert an axial force on the metering valve 134 to urge it toward a closed position against the bias of spring 144 to adjust the degree of opening of metering port 32 until an equilibrium condition is reached. The spring force of spring 144 is set by a movable seat 146 controlled by the throttle 148 to establish the speed at which equilibrium takes place.

As shown in FIG. 1, the free end of the metering valve 134 is provided with a drilled axial passage 162. A movable closure 166 is biased against the end of the metering valve 134 by the spring 144 to close the drilled passage.

The passage 162 is provided with a port 164 in the sidewall of metering valve 134 which communicates with an annulus 172. Outlet fuel from inlet pump 22 is bled into the annulus 172 through the bleed orifice 182. The pressure downstream of orifice 182 is automatically regulated to be in direct proportion to flyweight force by spilling fuel from passage 162 to the pump housing through slight separation between the end of the metering valve 134 and the closure 166. Since the spring force of spring 144 opposes flyweight force and this force is transmitted hydraulically between closure 166 and metering valve 134, the spill of fuel from passage 162 is in an amount to result in a pressure in passage 162 correlated with flyweight force. Further, since flyweight force is essentially proportional to the square of the speed, an equivalently proportioned $N^2$ control pressure is established in passage 162, as well as in annulus 172, passage 174, and annulus 176 to deliver a speed related $N^2$ control pressure to advance piston 64 and fuel or torque limiting piston 178 through passage 180 (FIG. 4).

Figure 3:
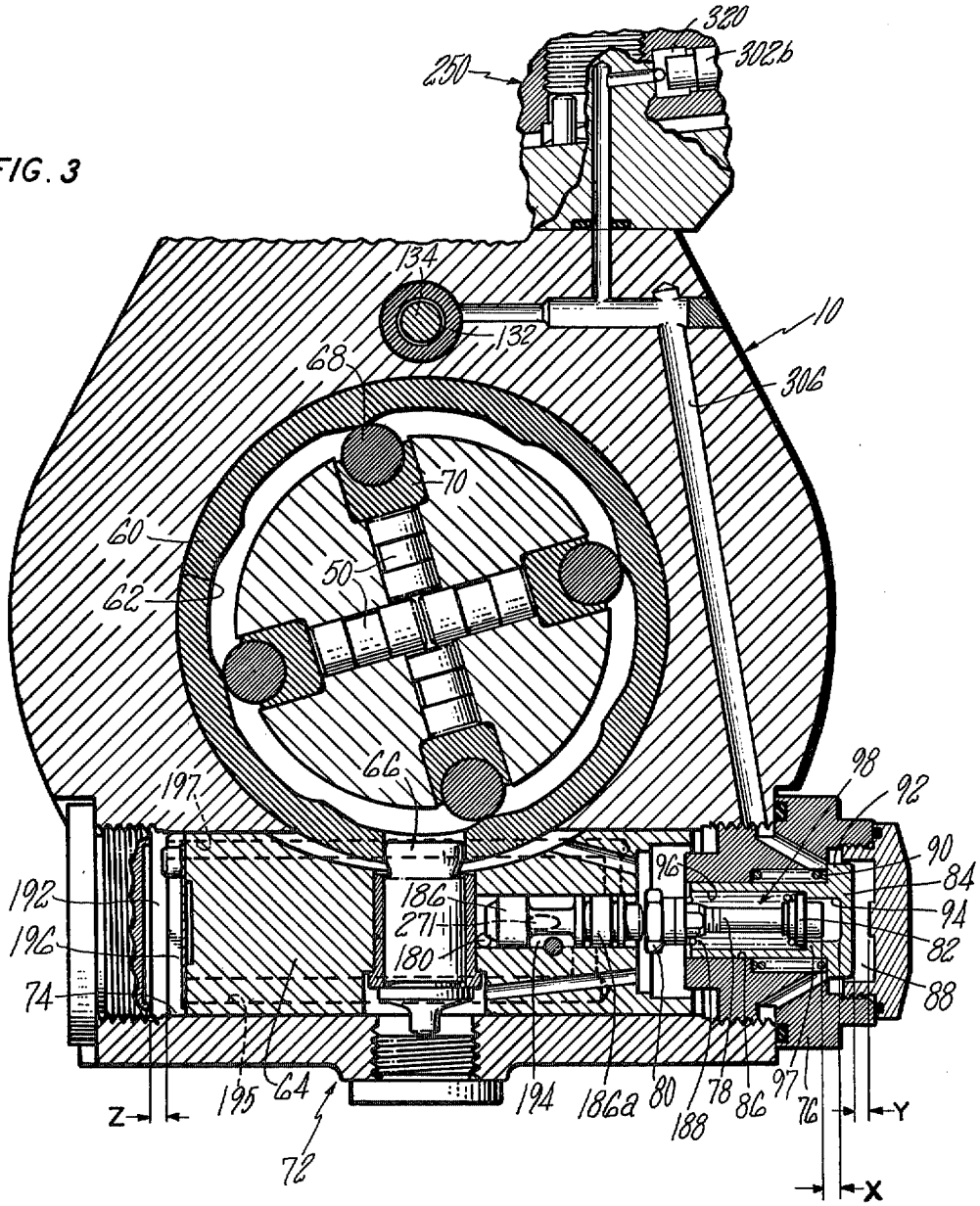
FIG. 3 is a fragmentary cross-sectional view taken substantially along line 3—3 of FIG. 1.

FIG. 3 shows a timing advance assembly 72 including the advance piston 64 operating in a cylinder 74 and a fixed advance spring cap 76 closing one end of the cylinder. As shown in the schematic flow diagram of FIG. 4, conduit 180 is connected to a passage 184 in advance piston 64 to deliver $N^2$ control pressure to operate a servo piston 186 which acts against the bias of an advance servo spring 188 to control the flow of fuel from supply pump 22 through a conduit 271 to chamber 192 at the end of cylinder 74 remote from the spring cap 76 via annulus 194 and passage 195 with reed valve 196 preventing reverse flow through passage 195 and preventing sharp pressure impulses imposed in the trapped fuel in chamber 192 from being present in annulus 194. Passage 197 is provided for dumping fuel from chamber 192 upon a reduction in speed, and/or an increase in load as will become evident.

As described in the aforementioned Pat. No. 3,861,833, when the axial position of servo valve 186 is in equilibrium under the influence of opposing forces of $N^2$ control pressure applied at one end and the spring force of spring 188 at the other end, the land **186*a* of servo valve 186 substantially blocks flow through both conduits 195 and 197. If engine speed decreases, the $N^2$ control pressure will decrease so that servo valve 186 is moved to the left to uncover conduit 197 to dump a portion of the fuel trapped in chamber 192 until a new position of the equilibrium of servo valve 186 is reached with a corresponding angular shift of the cam ring 60 to retard the timing of injection. Conversely, an increase in engine speed, and thus $N^2$ control pressure, operates to temporarily open the port of conduit 195 to add fuel to chamber 192 and thereby shift the cam ring 60** in the opposite direction to advance the time of injection.

In accordance with this invention, several factors operate to modify the speed dependent response by the advance piston 64,. Firstly, the reference position of servo spring 188 is variable in accordance with a load responsive control pressure in a conduit 306 (FIG. 4) or a conduit 406 (FIG. 5) connected to the advance cap 76 of the advance assembly 72. Secondly, the servo spring 188 is preloaded in a capsule such that the advance piston 64 is non-responsive to speed over an intermediate speed range. Thirdly, the gating of fuel at transfer pressure to conduit 271, only above a predetermined speed, by the positioning of fuel limiting piston 178, operates to maintain the advance piston 64 in its fully retarded position below the predetermined speed to facilitate starting. It will be understood that the speed dependent response of advance piston 64 will also be modified according to load due to a change in the $N^2$ control pressure resulting from a change in the radius of gyration of the flyweights 139 at different loads at each speed.

The advance servo spring 188 coaxially encircles the shank of a threaded bolt 78 and is compressively preloaded by and between a nut 80 threaded on the end of bolt 78 and a washer 82 slideably encircling the shank of the bolt and limited in movement by the bolt head, the nut, bolt and washer combining to form a capsule 98 for the spring. A generally cup-shaped spring holder piston 84 is supported in a cylinder formed by a blind or plugged bore 86 in advance cap 76 for axial movement relative to the advance cap and to the cylinder 74 to provide a movable reference position for the servo spring 188. The bore 86 axially opposes the piston 64 and is radially enlarged at its blind end to form a pressure chamber 88 with which the conduit 306 communicates to introduce fuel at a pressure corresponding with a particular engine operating condition, as for instance load as indicated by turbocharger boost pressure in the embodiment illustrated in FIGS. 1-4, as more fully described hereinafter.

A compressively preloaded bias spring 90 encircles the spring holder piston 84 in axial engagement with a radial flange 92 on the holder and the outer end of the chamber 88 to bias the holder toward the blind end of bore 86, which is also the inner end of the chamber.

Figure 7:
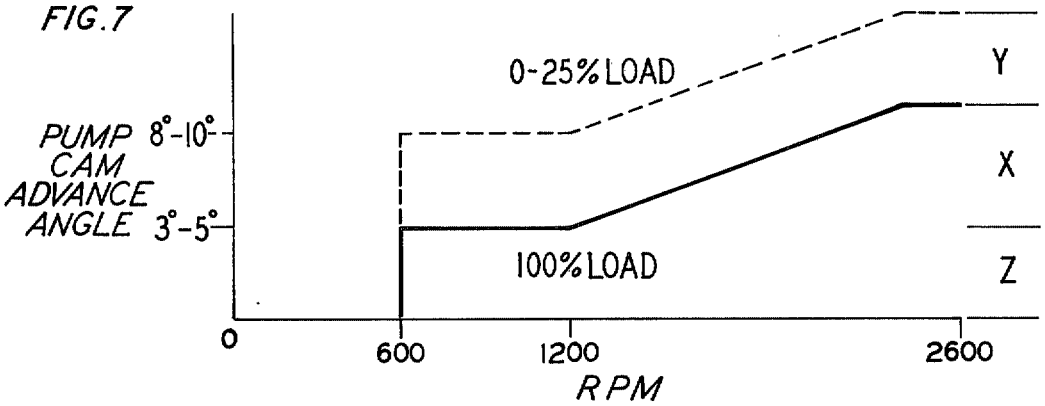
FIG. 7 is a graph illustrating the advance for 100% and 0–25% loads as a function of speed in accordance with one embodiment of the invention.

The spring holder piston 84 includes a blind axial bore 94 diametrally sized to pass the head of bolt 78 but not the washer 82, and a counterbore 96 sized to receive and provide a retaining shoulder 97 for the washer 82. The depth of bore 94 beyond shoulder 97 is such as to provide an axial spacing "x" between the base of the bore and the head of the bolt 78 when the head contacts the washer 82, this spacing being representative of the axial displacement of advance piston 64 possibly due to the $N^2$ control pressure alone. Stated another way, for a given positioning of spring holder piston 84, and thus washer 82 and spring 188, the servo piston 186, while in engagement with the bolt 78, may move a maximum distance of "x" relative to the positioning of the holder piston 84. Referring to FIG. 7, this distance "x" corresponds with an angular range of, say, about 5° to 6°, on the pump cam 60 and is the speed advance. It will be noted that the speed advance in the illustrated embodiment is zero or flat between about 600 and 1200 RPM. This is obtained by the preload on advance servo spring 188 and permits the advance to be sufficiently limited at rated speed to reduce $NO_x$ levels in the exhaust, while providing sufficient advance of injection timing in the lower, peak torque speed range to avoid exhaust smoke.

The spring holder piston 84 is biased against the blind end of bore 86 when the load-related control pressure in chamber 88 is low and moves inwardly to a stop limit after the pressure exceeds the preload of the spring 90. The maximum extent of axial travel of spring holder piston 84 is designated "y" in fIG. 3 and corresponds with a pump cam angle range of, say, 5° as seen on the curve of FIG. 7. This angular range comprises a load advance and the spring rate and preload of spring 90 are selected to provide a gradual advance, say, from 100% load to about 25% load.

The aforedescribed advance assembly 72 is thus operative in response to the speed related $N^2$ pressure and the load related control pressure signal to modify the timing of the pump with changes of both speed and load for achieving improved engine operation with reduced $NO_x$ and exhaust smoke emissions.

The $N^2$ control pressure from conduit 180 controls the axial position of fuel limiting plunger 178 by controlling the addition to, and the dumping from, the chamber 202 of fuel by the position of the servo valve 204 relative to plunger 178.

Fuel output of the inlet pump 22 is also admitted to conduit 190 (FIG. 1) which communicates with the cavity 201 (FIGS. 2, 4) adjacent fuel limiting plunger 178. The cavity 201 is connected to annulus 211 on valve 204 by passage 205. Fuel at $N^2$ control pressure enters chamber 203 at one end of valve 204 via a conduit 180. At the opposite end of servo valve 204 is a bias spring 208 which is adjustable by means of screw 207. Servo valve 204 reaches a position of equilibrium when the pressure in chamber 203 equals the spring force of spring 208.

Figure 2:
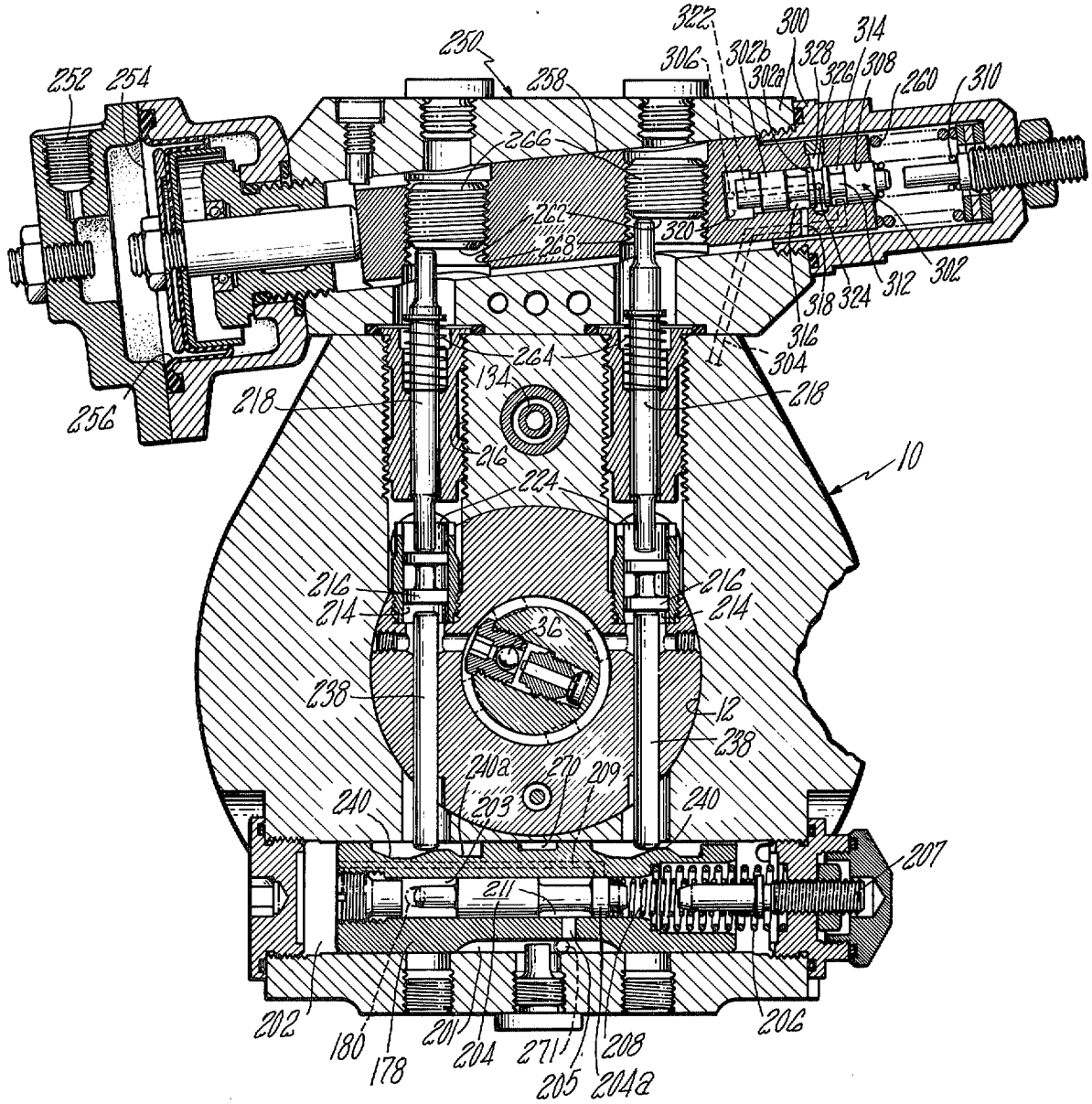
FIG. 2 is a cross-sectional view taken substantially along line 2—2 of FIG. 1.

As shown in FIG. 2, the fuel limiting plunger 178 is provided with an axial passage 209 having a radial port communicating with the servo valve chamber controlled by land 204*a*. Since conduit 190 delivers pressure from supply pump 22 to the annulus 211, additional fuel may enter the chamber 202 when the land 204*a* is to the right of the port of conduit 209 as viewed in FIG. 2, and trapped fuel in chamber 202 is dumped from chamber 202 when the land 204*a* is to the left of the port to control the axial position of fuel limiting plunger 178 according to engine speed..

When the rotor 18 rotates to cause the registry of axial slot 210 (FIG. 4) with the port 212, metered fuel is delivered to shuttle chamber 214 to move the shuttle 216 upwardly from its position of rest on stop 238. If the metering port 32 is only partly open, upward movement of the shuttle 216 is terminated when the registry of slot 210 of the rotor and the port 212 is terminated. Stop 218 limits the maximum upward movement of the shuttle 216. During the shuttle charging period, slot 222 on the rotor and port 220 are also in registry, as shown in FIG. 2, to dump the fuel in the shuttle chamber 224 above the shuttle 216 back to the tank through passages 228 and 158, and housing pressure regulator 160.

Continued rotation of the rotor 18 causes axial slot 230 to move into registry with the port 212 and slot 232 to move into registry with port 234. As a result, pressurized fuel from inlet pump 22 is delivered by passage 26 to shuttle chamber 224 to power the shuttle downward against stop 238 and serve as a positive displacement pump to deliver the charge of fuel previously delivered to shuttle space 214 into the pump chamber 38 (FIG 1) past ball valve 36.

Further rotation of the rotor 18 concludes the charging of pump chamber 38 with shuttle 216 against stop 238. The functioning of the shuttle 216 and the feeding of metered charges of fuel to the pump chamber 38 has been described in connection with a single shuttle. However, in practice, a pair of alternatively functioning, identical shuttles 216 are used, as shown in FIG. 2.

Since the axial position of movable stop 238 is set by the profile of cam surface 240 of fuel limiting plunger 178 in accordance with engine speed as previously described, it is apparent that by shaping the profile of cam surface 240 the maximum shuttle movement at different engine speeds can be easily adjusted to provide any desired schedule of maximum fuel delivery versus speed and, therefore, a torque curve customized for any engine. Further, the cam surface 240 may be profiled to include a recess, such as shown at 240*a* to provide excess fuel for starting.

Starting is also usually improved by causing injection timing to be retarded and a retardation of injection timing during starting is provided in accordance with one aspect of the invention, by preventing the admission of fuel at transfer pressure to power the advance piston 64 when the fuel limiting plunger 178 is in the excess fuel or starting position thus causing the advance piston 64 to operate at its maximum retard position. A preloaded bias spring 206 acts against the fuel limiting plunger 178 to oppose displacement of the plunger 178 by fuel entering the chamber 202 until a pressure commensurate with a preselected speed is reached. In other words, even though the land 204a may have reached an equilibrium position to the left of the port of conduit 209, the bias spring 206 prevents movement of the plunger 178 to close the port until the pressure in chamber 202, which is correlated with engine speed, exceeds the preload of the spring, which corresponds with a speed of about 600 RPM in the embodiment illustrated. This prevents axial movement of the fuel limiting plunger 178 at the lower range of speeds commensurate with engine starting, and the recess 240a for excess starting fuel need only be of limited axial extent.

An annulus 270 on the fuel limiting plunger 178 communicates with the cavity 201 to receive fuel at transfer pressure from conduit 190. The annulus 270 is positioned and dimensioned axially of the plunger 178 such that it moves axially into communication with the port of a conduit 271 leading to advance piston 64 only after the plunger 178 has moved axially beyond a starting speed position, in this instance corresponding with about 600 RPM. It will be appreciated that the plunger 178 is essentially non-rotating and the angular extent of cavity 201, which may be of greater axial extent than annulus 270, is limited such that it never directly registers with the port of conduit 271 to interfere with the control. The annulus 270 is thus operative to connect the conduit 271 with the fuel at transfer pressure only after a starting speed is exceeded to provide a maximum retardation of timing for starting.

During starting, the land 186a of advance servo piston 186 will have previously opened the port to conduit 271 to provide communication between it and the annulus 194 such that when the fuel at transfer pressure is connected to conduit 271 at a speed of about 600 RPM, the advance piston 64 is instantly moved rightwardly by a distance designated "z" in FIG. 3 from its fully retarded position to a position corresponding with a relative pump cam advance angle of, say, about 3°-5° at 100% load and 8°-10° below 25% load.

The pump illustrated in FIGS. 1-4 is suitable for use with a turbocharged engine, and, accordingly, a feature of one embodiment of this invention is the inclusion of means to regulate maximum fuel delivered per pumping stroke and injection timing which is responsive to intake air pressure to the engine for adjustably controlling the advance piston 64. A control assembly 250 receives air at intake manifold air pressure at inlet 252 which communicates with the diaphragm chamber 254. Diaphragm 256 in chamber 254 operatively engages a cut-back piston 258 slideably mounted in a bored housing 300 to axially move the cut-back piston in response to changes in the intake manifold air pressure. A bias spring 260 at the opposite end of the cut-back piston 258 urges the cut-back piston leftwardly, as viewed in FIG. 2, and an increase in the air pressure at inlet 252 acts to overcome the spring bias and move the cut-back piston rightwardly to a position of equilibrium which corresponds with the intake manifold air pressure.

Intake manifold air pressure under steady state conditions is a function of load and thus is a load related signal. This pressure is relatively low under conditions of light load during which a relatively advanced timing is desired and is relatively high under high load conditions. During transient periods of rapid acceleration, intake manifold air pressure is momentarily lower than normal until the turbocharger achieves steady state speed at the new throttle setting, during which time it is also desirable to advance the timing to prevent certain exhaust smoke conditions. Therefore, intake manifold air pressure or the related motion of cut-back piston 258 may be used to develop the liquid pressure signal for controlling timing advance with decreasing load in the manner previously described.

A pressure regulating valve 302 is additionally housed in housing 300 and operates in cooperation with the boost pressure responsive cut-back piston 258 to regulate the pressure of fuel from conduit 304 to the timing advance assembly 72 such that the pressure in the conduit 306 is related to the turbocharger boost pressure, and thus is a load related pressure.

The pressure regulation valve 302 is slideably mounted in an axial bore 308 in the end of cut-back piston 258 which is remote from the diaphragm 258. A biasing spring 310 urges the regulating valve 302 inwardly in the bore 308 in opposition to outward movement of the cut-back piston 258 as turbocharger boost pressure increases. The regulating valve slidingly seals the bore 308 at its outer end from fuel at housing pressure introduced to the housing by conduit means, not shown. A necked-down portion 312 of the regulating valve 302 is aligned with a port in conduit 304 which extends from conduit 26 into the cut-back piston 258 to provide an annulus 314 for the admission of fuel at transfer pressure to the bore 308. A land 302a axially separates and seals the annulus 314 from a second axially inward annulus 316. A radial passage 318 through the wall of the cut-back piston 258 communicates with the annulus 316 to introduce fuel at housing pressure thereto.

A land 302b axially inwardly of the annulus 314 defines a chamber 320 with the inner end of the bore 308 and seals the chamber from the housing pressure in the annulus 316. The inner or free end of the regulating valve 302 is provided with a drilled axially passage 322 which communicates with the chamber 320 and with a radial passage 324 in the land 302a. The land includes an annular groove 326 axially centrally thereof with which the radial passage 324 communicates. A hole 328 in the wall of bore 308 is spaced axially toward the blind end of the bore and is substantially the same width as the land 302a such that axial movement of piston 258 to the right permits communication between the annulus 314 and the hole 328 thereby introducing fuel to the chamber 320 through the radial and axial passages 324 and 322 respectively in the valve.

The pressure of fuel admitted to the chamber 320 will act axially outwardly on the regulator valve 302 and its bias spring 310 to move land 302a back into sealing relation between the annulus 314 and the hold 328 whereupon a condition of equilibrium will be established. The relative axial movement between the land 302a and the hole 328 which places the annulus 314 in communication with the hole results from an outwardly axial displacement of the cut-back piston 258 within housing 300 in response to an increase in intake manifold air pressure. Accordingly, as boost pressure increases and the piston 258 moves farther outward, an increased pressure in chamber 320 is required to overcome the spring 310 and re-establish an equilibrium positioning of the valve 302. Conversely, a decrease in pressure results in a decreased pressure in chamber 320.

The pressure in chamber 320 thus corresponds with the intake manifold air pressure to provide a control pressure to the fuel in the conduit 306 which leads to chamber 88 of the advance assembly 72.

In another embodiment of the invention, in which the engine might be naturally aspirated and thus not require the presence of a turbocharger system the load advance control pressure supplied to chamber 88 in advance spring cap 76 is derived from the positioning of the fuel metering valve 134', as seen in FIG. 5, and thus is related to the load on the engine at any particular setting of throttle 148.

As earlier described, the governor flyweight assembly 139 acts to maintain a throttle-set speed of the associated engine, despite varying loads, by axially moving the fuel metering valve 134' to variably cover or uncover the fuel metering port 32. Accordingly, the axial positioning of metering valve 134' relative to its positioning for a particular throttle setting is proportional to the load on the engine at that throttle setting, with a relatively lighter load resulting in rightward movement of the valve 134 (as viewed in FIG. 5) to close the port 32 and vice versa.

In the embodiment of the invention illustrated in FIG. 5, the metering valve 134' includes an annular groove 408 which selectively connects with either the port of conduit 410 or the port of conduit 412 for applying a fuel pressure in substantially an on-off manner as a control pressure to conduit 406 which is in turn connected to chamber 88 in the advance spring cap 76 of advance assembly 72. The conduit 410 is connected to a source of fuel at transfer pressure, as for instance conduit 30, and the conduit 412 is connected to a source of fuel at the lower housing pressure, as for instance passage 158. The ports in governor tube 132 for the respective conduits 410 and 412 are axially spaced from one another, and the axial width of annular groove 408 is such that only one or the other of the conduits 410 and 412 communicates with it at any time.

The ports for conduits 410 and 412 are axially relatively positioned such that fuel at housing pressure in conduit 412 communicates with conduit 406 at a low fuel, low load rightward positioning of metering valve 134', and fuel at transfer pressure in conduit 410 communicates with conduit 406 at a relatively higher fuel, higher load leftward positioning of the metering valve. The transition or switching from housing pressure to transfer pressure (and vice versa) in conduit 406 is abrupt and may be selected to occur in the area of about 25% load to provide the entire low load turn-up advance of about 5° for load conditions below 25% load and no advance from the load related signal above 25% load, thereby providing an on-off switched type of timing control.

An alternative to the embodiment illustrated in FIG. 5 appears in the embodiment illustrated in FIG. 6 in which the axial width of annular groove 508 in metering valve 134" is greater than the axial spacing between the respective ports of the transfer pressure conduit 410 and the housing pressure conduit 412 respectively, such that the load advance is modulated in accordance with the relative amount of transfer pressure and housing pressure which is fed into chamber 88 by conduit 406. The pressure appearing in conduit 406 may be anywhere in a continuum extending from the lower housing pressure to the higher transfer pressure, as determined by the load related axial positioning of metering valve 134". This arrangement is analogous to the manifold air intake pressure related control signal provided in the embodiment illustrated in FIGS. 1–4 and, accordingly, when the control pressure in conduit 406 and chamber 88 exceeds the preload of spring 90 at a predetermined load level, the piston 84 is moved to the left and thereafter the advance changes continuously with load.

According to another aspect of the invention, an intake manifold air controlled mechanism, such as the diaphragm 256 and cut-back piston 258 may be used to vary the position of shuttle stops 218 to adjust the maximum possible fuel charge in chambers 214 in relation to the intake air pressure to the engine in order to prevent fuel charge volumes which exceed those required for good combustion for particular volumes of intake air.

The shuttle stops 218 are axially movable and the aneroid cut-back piston 258 extends transversely of the axial paths of the stops 218 in a position which limits their axial travel. The ends of the stops 218 remote from the shuttles 216 are urged by bias springs 264 axially outwardly into contact with a pair of respective cam surfaces 262 which move with the cut-back piston 258. The cut-back piston 258 is inclined from the normal, relative to stops 218, and the cam surfaces 262 are perpendicular to the ends of stops 218 such that rightward axial movement of the cut-back piston 258 due to increasing intake manifold air pressure results in outward movement of the stops 218 relative to the head 10, resulting in outward movement of stops 218 and, thus, a greater spacing between stops 218 and 238, thereby permitting increased maximum displacement of the shuttle 216. In the illustrated embodiment, the cam surfaces 262 are provided by the ends of a pair of threaded plugs 266 which are in threaded engagement with a pair of respective threaded holes 268 extending through the cut-back piston 258 at an angle slightly skewed from the radial. The movable stops 218 are thus operative to also limit the displacement of shuttle 216 as a function of intake manifold air pressure. The plugs 266 may be adjustably positioned axially of the holes 268 to accomodate any differences in length between the pairs of stops 218 and 238 that might result from manufacturing and so that the displacement range limit of each may be set independently of the other.

As will be apparent to persons skilled in the art, various modifications, adaptations and variations of the foregoing specific disclosure can be made without departing from the teachings of the present invention.

We claim:

1. In a fuel injection pump for an associated internal combustion engine, pump plunger means providing sequential pumping strokes, means for changing the timing of the pumping strokes comprising a cylinder, an advance piston movable in said cylinder, means interconnecting said advance piston with said pump plunger means to advance and to retard the relative timing of the pumping strokes, a first source of fluid having a pressure correlated with engine speed, means operatively connected to said advance piston for moving said advance piston in response to said first pressure to change the relative timing of said pumping strokes including a source of operating fluid under pressure to power said advance piston, a conduit for delivering said operating fluid to said advance piston, and gating means in said conduit responsive to said first fluid pressure for disabling said operation of said advance piston moving means so that said advance piston is in a position corresponding with a fully retarded relative timing of pumping up to a predetermined speed, said gating means comprising a fuel limiting plunger intersecting said conduit to control the flow of said operating fluid to said advance piston, and means operatively connected to said fuel limiting plunger to move the same in response to said first fluid pressure for changing the maximum fuel charge delivered to the pump plunger means.

2. A fuel injection pump according to claim 1 wherein said fuel limiting plunger includes bias means preloaded to prevent axial movement of said fuel limiting plunger until said predetermined speed is reached.

3. A fuel injection pump according to claim 1 including a second source of fluid having a pressure correlated with the pressure of inlet air to the engine, and means operatively connected to said advance piston to change the relative timing of pumping strokes in response to the pressure of said inlet air.

4. A fuel injection pump according to claim 1 wherein said pump includes a conduit for delivering fuel to said pump plunger means, a metering valve in said conduit for regulating the quantity of fuel in each of said pumping strokes, and means operatively connected to said advance piston for moving said advance piston in response to the pressure in said conduit downstream of said metering valve to change the relative timing of said pumping strokes in accordance with the position of said metering valve.

5. In a fuel injection pump for an associated internal combustion engine, pump plunger means providing sequential pumping strokes, means for changing the timing of the pumping strokes comprising a cylinder, an advance piston movable in said cylinder, means interconnecting said advance piston with said pump plunger means to advance and to retard the relative timing of the pumping strokes, a first source of fluid having a pressure correlated with engine speed, means operatively connected to said advance piston for moving said advance piston in response to said first pressure to change the relative timing of said pumping strokes including a source of operating fluid under pressure to power said advance piston, and gating means responsive to said first fluid pressure for disabling said operation of said advance piston moving means so that said advance piston is in a position corresponding with a fully retarded relative timing of pumping up to a predetermined speed, said advance piston moving means includes a servo mechanism including a servo piston and a servo spring, said first fluid pressure acting on said servo piston in opposition to said servo spring to establish an equilibrium position of said advance piston, a second cylinder, a spring holder piston movable in said second cylinder, said servo spring being mounted for movement with said spring holder piston to vary the reference position of said servo spring thereby to vary the equilibrium positioning of said advance piston, preloaded spring means for biasing said spring holder piston to a position commensurate with advanced relative timing of pumping, and a second fluid pressure connected to said second cylinder to act on said spring holder piston in opposition to said preloaded spring means, said second fluid pressure being correlated with a particular variable engine operated condition other than for said first fluid pressure, and the preload of said spring means being overcome by said second fluid pressure at a predetermined level of said particular operating condition of the engine to move said servo spring holder toward a position commensurate with a relatively retarded timing thereby to modify the timing control of said first fluid pressure.

6. In a fuel injection pump for an associated engine, pump plunger means providing sequential pumping strokes, means for changing the timing of the pumping strokes comprising a first cylinder, an advance piston movable in said first cylinder, means interconnecting said advance piston with said pump plunger means to advance and to retard the relative timing of the pumping strokes; a first source of fluid having a pressure correlated with engine speed, a second source of fluid having a pressure correlated with a variable engine operating condition other than speed, means operatively connected to said advance piston and responsive to said first fluid pressure and said second fluid pressure for moving said advance piston to change the relative timing of pumping strokes, said advance piston moving means comprising a servo mechanism including a servo piston for controlling the flow of an operating fluid to position said advance piston, and a servo spring, said first fluid pressure being connected to act on said servo piston in opposition to said servo spring to establish an equilibrium position of said advance piston; a second cylinder, a spring holder piston movable in said second cylinder, said servo spring being mounted for movement with said spring holder piston to vary the reference position of said servo spring thereby to vary the equilibrium positioning of said advance piston, means biasing said spring holder piston to a position commensurate with advanced relative timing of pumping, and said second fluid pressure being connected to said second cylinder to act on said spring holder piston in opposition to said bias means, said second fluid pressure being operative to overcome said bias means to move said servo spring holder toward a position commensurate with a relatively retarded timing thereby to modify the timing control of said first fluid pressure.

7. A fuel injection pump according to claim 6 wherein said bias means includes spring means in biasing engagement with said spring holder piston.

8. A fuel injection pump according to claim 7 wherein said spring means is preloaded to a prescribed level.

9. A fuel injection pump according to claim 6 wherein said servo spring is preloaded in compression.

10. A fuel injection pump according to claim 6 including a pump chamber for receiving measured charges of liquid fuel, automatically positionable means for metering the fuel delivered to the pump chamber to provide said measured charges thereto, and means for generating said second fluid pressure responsive to and correlated with the positioning of said fuel metering means, said second fluid pressure being relatively greater for relatively increased fuel delivery to the engine.

11. A fuel injection pump according to claim 10 wherein the force of said second fluid pressure on said spring holder piston is less than the force of said biasing means for positions of said fuel metering means to one side of a switching position and exceeds the preload force of said preloaded spring for positions of the fuel metering means to the other side of the switching position thereby to move the spring holder piston rapidly from one extreme to the other to provide a substantially on-off advance control.

12. A fuel injection pump according to claim 10 including a relatively high pressure source of fluid and a relatively low pressure source of fluid, said high pressure source being sufficient to overcome said spring preload and said low pressure source being insufficient to overcome said spring preload, means for interconnecting variable portions of both said high and said low pressure sources to generate said second pressure, and said fuel metering means is operatively connected to said interconnection means for modulating said interconnection of said high and low pressure sources to continuously vary said second fluid pressure between said relatively high and relatively low fluid pressures.

13. A fuel injection pump according to claim 12 wherein said high pressure source of fluid and said low pressure source of fluid each have a respective port spaced from one another along said fuel metering means adjacent thereto, said fuel metering means includes a groove therein for simultaneous communication with variably sized portions of said ports of said high pressure and low pressure fluid sources respectively, the relative sizes of the portions of said ports in communication with said groove varying with the positioning of said fuel metering means to continuously modulate the fuel pressure in said groove, said second fluid pressure comprising said modulated fuel pressure.

14. A fuel injection pump according to claim 6 wherein said engine is turbocharged to boost the pressure of intake air to the engine, and including means for generating said second fluid pressure responsive to and in correlation with said turbocharger boost pressure, said second fluid pressure increasing and decreasing with increasing and decreasing turbocharger boost pressures respectively, said boost pressure being relatively lower both for relatively low engine load conditions and for an increase of fuel delivered to the engine during acceleration.

15. A fuel injection pump according to claim 8 including gating means responsive to said first fluid pressure for disabling said operation of said advance piston moving means so that said advance piston is in a position corresponding with a fully retarded relative timing of pumping up to a predetermined speed.

16. In a fuel injection pump for an associated engine including a pump chamber for pressurizing measured charges of liquid fuel for delivery to the engine, means for metering the fuel delivered to the pump chamber to provide measured charges of fuel in amounts correlated with engine operating conditions, a bore in the housing of said pump mounting a shuttle, a first chamber of one end of said shuttle receiving the measured charges of fuel prior to their delivery to the pump chamber, a second chamber disposed at the other end of said shuttle, a source of hydraulic pressure intermittently connected to said second chamber to actuate said shuttle to deliver the previously metered charges of fuel to the pump chamber for pressurization, pump plunger means providing sequential pumping strokes to the fuel delivered to the pump chamber, first and second stop means at opposite ends of said bore to limit the maximum movement of said shuttle in each direction, one of said stop means being selectively axially movable during operation in response to inlet air pressure to the engine for axially moving said one stop means toward and away from the other of said stop means, and the other of said stop means being independently movable during operation in response to engine speed.

17. In a fuel injection pump for an associated internal combustion engine, pump plunger means providing sequential pumping strokes, means for changing the timing of the pumping strokes comprising a cylinder, an advance piston movable in said cylinder, means interconnecting said advance piston with said pump plunger means to advance and to retard the relative timing of the pumping strokes, a first source of fluid having a pressure correlated with engine speed, means operatively connected to said advance piston for moving said advance piston in response to said first pressure to change the relative timing of said pumping strokes including a source of operating fluid under pressure to power said advance piston, a second source of fluid having a pressure correlated with intake manifold air pressure to the engine, and means responsive to said second pressure for moving said advance piston in response to said second pressure to change the relative timing of said pumping strokes, said second means comprising a movable spring holder piston positioned at one end of said advance piston and a spring operatively connected to said advance piston to oppose the movement thereof in response to said first pressure, said spring holder piston serving as a spring seat for said spring, said second pressure acting on said spring holder piston to vary the reference position of said spring.

* * * * *